US008746679B2

(12) United States Patent
Hanyu

(10) Patent No.: US 8,746,679 B2
(45) Date of Patent: Jun. 10, 2014

(54) SHEET FEED ROLLER

(75) Inventor: Atsushi Hanyu, Kobe (JP)

(73) Assignee: Sumitomo Rubber Industries, Ltd., Kobe (JP)

( * ) Notice: Subject to any disclaimer, the term of this patent is extended or adjusted under 35 U.S.C. 154(b) by 31 days.

(21) Appl. No.: 13/554,158

(22) Filed: Jul. 20, 2012

(65) Prior Publication Data

US 2013/0062826 A1 Mar. 14, 2013

(30) Foreign Application Priority Data

Sep. 14, 2011 (JP) ..... 2011-200703

(51) Int. Cl.
*B65H 3/06* (2006.01)

(52) U.S. Cl.
USPC ..... 271/119; 271/109; 193/37

(58) Field of Classification Search
USPC ..... 271/109, 119, 120; 198/37; 193/37
See application file for complete search history.

(56) References Cited

U.S. PATENT DOCUMENTS

| | | | | |
|---|---|---|---|---|
| 5,372,359 | A * | 12/1994 | Miura et al. | 271/119 |
| 5,954,328 | A * | 9/1999 | Hatanaka | 271/119 |
| 7,758,039 | B2 * | 7/2010 | Lee | 271/119 |

FOREIGN PATENT DOCUMENTS

| | | | | |
|---|---|---|---|---|
| JP | 61-132346 | U | | 8/1986 |
| JP | 01087436 | A | * | 3/1989 |
| JP | 04256634 | A | * | 9/1992 |
| JP | 06199432 | A | * | 7/1994 |
| JP | 8-157086 | A | | 6/1996 |
| JP | 11-222323 | A | | 8/1999 |
| JP | 2003146457 | A | * | 5/2003 |

* cited by examiner

*Primary Examiner* — Ernesto Suarez

(74) *Attorney, Agent, or Firm* — Birch, Stewart, Kolasch & Birch, LLP

(57) ABSTRACT

A noncircular sheet feed roller includes a core and a rubber belt mounted on the core. The core includes a peripheral member having a peripheral surface which is arcuate about a center axis thereof, and a pair of support ribs which are provided opposite from the arcuate peripheral surface of the peripheral member to be spaced from the peripheral member by a space and extend parallel to the center axis symmetrically with respect to the center axis. The rubber belt is a looped belt which has a predetermined width as measured along the center axis and has an inner peripheral surface and an outer peripheral surface. The peripheral member is inserted in the rubber belt, and a portion of the rubber belt is fitted in the space between the peripheral member and the support ribs.

7 Claims, 6 Drawing Sheets

2
2c
5
6
7
7c
11
12
13
14
15
C
D
Y

SHEET FEED ROLLER

BACKGROUND OF THE INVENTION

1. Field of the Invention

The present invention relates to a sheet feed roller.

2. Description of Related Art

Sheet feed rollers are used, for example, for transporting paper sheets in image forming apparatuses such as printers and facsimiles. There are two types of sheet feed rollers, i.e., a constant contact type and a non-constant contact type. A sheet feed roller of the constant contact type has a circular sectional shape, and is constantly kept in contact with a paper sheet. A sheet feed roller of the non-constant contact type has a noncircular sectional shape, and is brought into contact with a paper sheet only during the transportation of the paper sheet.

The sheet feed roller of the non-constant contact type is advantageous in that an ingredient (oil or the like) of a rubber of the sheet feed roller does not migrate to a paper sheet held in standby for transportation. In Patent Literature 1 (JP-HEI11(1999)-222323A), for example, an exemplary sheet feed roller of the non-constant contact type is disclosed, which includes a core having a semicircular sectional shape and a looped rubber belt fitted around a peripheral surface of the core.

SUMMARY OF THE INVENTION

In the sheet feed roller of the non-constant contact type, however, the elongation percentage of the looped rubber belt fitted around the core can be changed only by changing the inner diameter of the looped rubber belt relative to the outer peripheral dimension of the core. This, makes it practically impossible to control the elongation percentage, resulting in difficulty in controlling the performance of the rubber belt when designing and producing the rubber belt.

If the rubber belt has a lower elongation percentage, the rubber belt is liable to be slacked. If the rubber belt has an excessively high elongation percentage, on the other hand, the rubber belt is liable to be permanently elongated or to be cracked due to ozone. If an anti-aging agent is added to the rubber for prevention of the cracking, paper sheets are likely to be stained by the anti-aging agent.

It is therefore an object of the present invention to provide a sheet feed roller which is substantially free from the slack and the excessive elongation of a rubber belt thereof.

A sheet feed roller according to the present invention is a noncircular sheet feed roller which includes a core and a rubber belt mounted on the core. The core includes a peripheral member having a peripheral surface which is arcuate about a center axis thereof, and a pair of support ribs which are provided opposite from the arcuate peripheral surface of the peripheral member to be spaced from the peripheral member by a space and extend parallel to the center axis symmetrically with respect to the center axis. The rubber belt is a looped belt which has a predetermined width as measured along the center axis and has an inner peripheral surface and an outer peripheral surface. The peripheral member is inserted in the rubber belt, and a portion of the rubber belt is fitted in the space between the peripheral member and the support ribs, whereby the rubber belt is mounted on the core with the inner peripheral surface thereof partly held in intimate contact with the arcuate peripheral surface and with a predetermined part of the outer peripheral surface thereof supported by the support ribs.

With this arrangement, the rubber belt is partly bent by the pair of support ribs and fixed to the core with the inner peripheral surface thereof held in intimate contact with the arcuate peripheral surface when the rubber belt is mounted on the core. This prevents the slack of the rubber belt. Further, the provision of the pair of rubber ribs increases the design flexibility for controlling the elongation percentage of the rubber belt. As a result, the rubber belt is substantially prevented, for example, from having an excessively high elongation percentage.

The sheet feed roller is attachable to a rotation shaft by engaging the rotation shaft into a center axis position through a gap defined between the pair of support ribs. With the sheet feed roller attached to the rotation shaft, the portion of the rubber belt fitted in the space preferably has an elongation percentage of not higher than 25%.

With this arrangement, the rotation shaft depresses a portion of the rubber belt stretched between the pair of support ribs to tighten the rubber belt, whereby the inner peripheral surface of the rubber belt is reliably kept in intimate contact with the arcuate peripheral surface. Further, the pair of support ribs support the rubber belt inside the core, so that the portion of the rubber belt depressed to be elongated by the rotation shaft has a smaller area. As a result, the elongated portion of the rubber belt has an elongation percentage of not higher than 25%. This prevents the permanent elongation of the rubber belt, and suppresses the cracking of the rubber belt due to ozone.

In the sheet feed roller, the portion of the rubber belt fitted in the space preferably has an elongation percentage of not higher than 10%.

This arrangement reliably prevents the permanent elongation of the rubber belt, and suppresses the cracking of the rubber belt due to ozone.

The present invention also provides an image forming apparatus including the aforementioned sheet feed roller.

With this arrangement, the rubber belt of the sheet feed roller advantageously functions in the image forming apparatus. Therefore, the image forming apparatus is free from sheet feeding failures.

DETAILED DESCRIPTION OF PREFERRED EMBODIMENTS

An embodiment of the present invention will hereinafter be described with reference to the attached drawings.

Figures 1A, 1B, 1C, 1D:
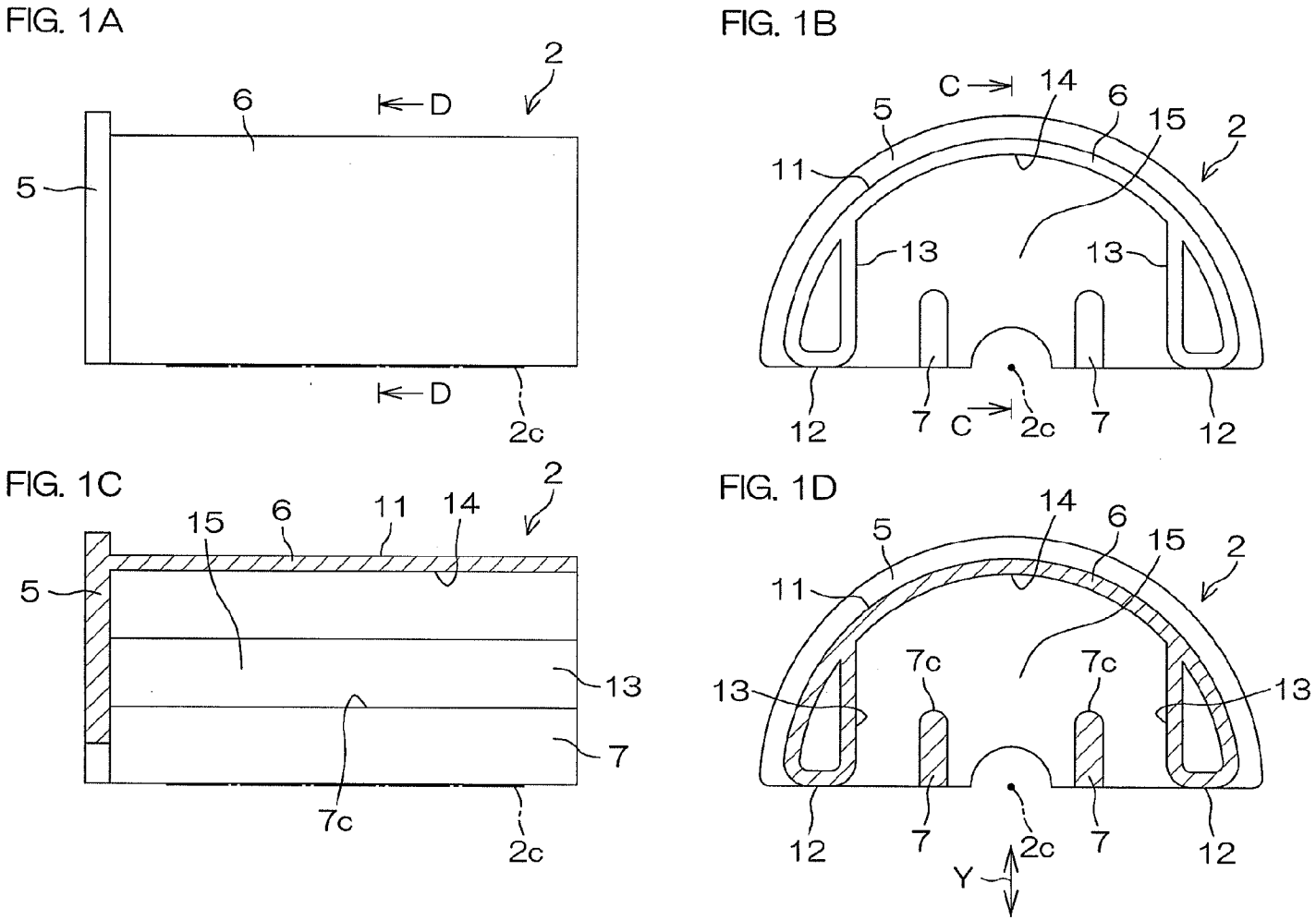
FIGS. 1A to 1D are diagrams illustrating a core 2 of a sheet feed roller 1 according to one embodiment of the present invention, particularly, FIG. 1A being a side view of the core 2, FIG. 1B being a front view of the core 2, FIG. 1C being a side sectional view of the core 2 (taken along a line C-C in FIG. 1B), FIG. 1D being a front sectional view of the core 2 (taken along a line D-D in FIG. 1A).
Figures 2A, 2B:
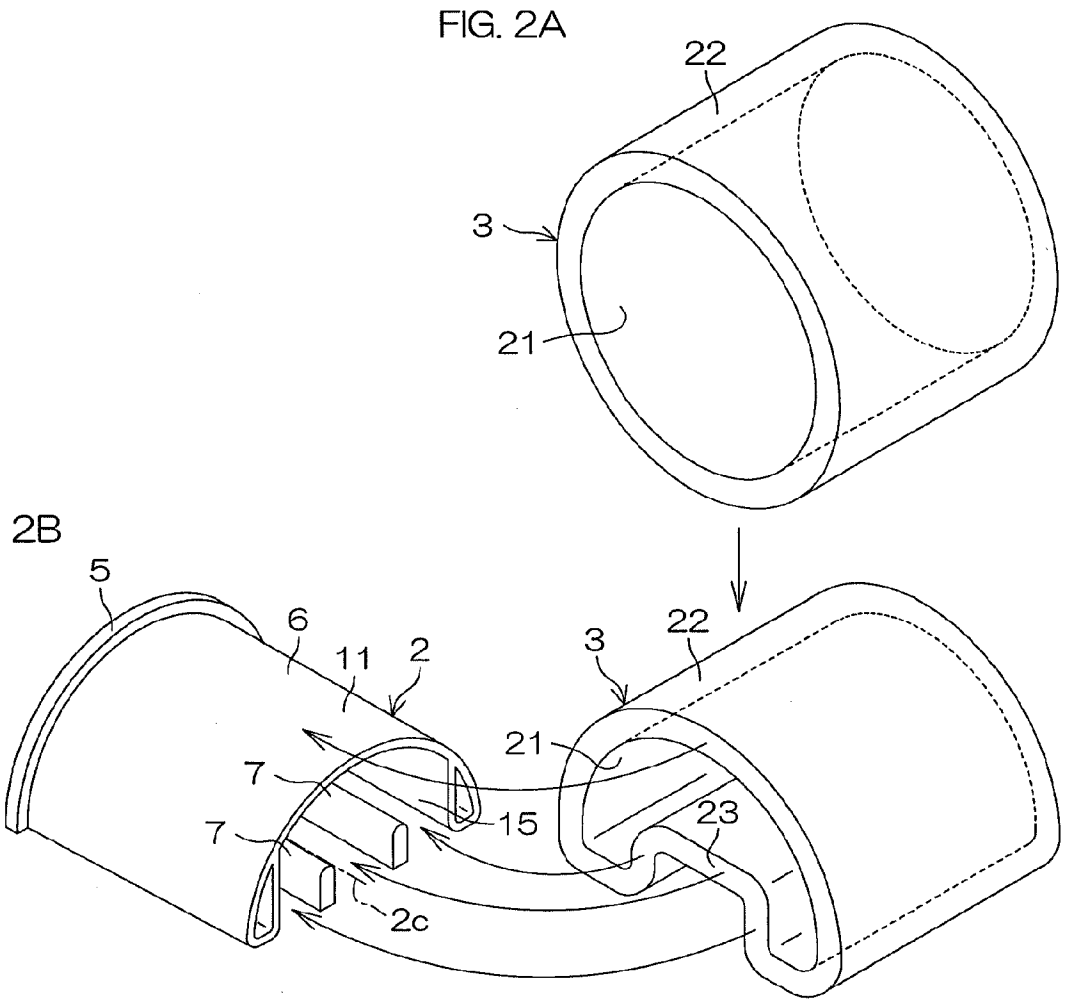
FIGS. 2A and 2B are perspective views showing how to mount a rubber belt 3 on the core 2, particularly, FIG. 2A being a perspective view of the rubber belt 3 before the mounting, FIG. 2B being a perspective view of the rubber belt 3 and the core 2 during the mounting.

FIGS. 1A to 1D are diagrams illustrating a core 2 of a sheet feed roller 1 according to one embodiment of the present invention, particularly, FIG. 1A being a side view of the core 2, FIG. 1B being a front view of the core 2, FIG. 1C being a side sectional view of the core 2 (taken along a line C-C in FIG. 1B), FIG. 1D being a front sectional view of the core 2 (taken along a line D-D in FIG. 1A). FIGS. 2A and 2B are perspective views showing how to mount a rubber belt 3 on the core 2, particularly, FIG. 2A being a perspective view of the rubber belt 3 before the mounting, FIG. 2B being a perspective view of the rubber belt 3 and the core 2 during the mounting.

Referring first to FIGS. 2A and 2B, the sheet feed roller 1 includes a core 2, and a rubber belt 3 mounted on the core 2. The core 2 has a semicircular cross section, and extends along a center axis 2*c* thereof to have a predetermined length. The core 2 has a base flange 5 extending perpendicularly to the center axis 2*c*. The core 2 includes a peripheral member 6 and a pair of support ribs 7 supported on one side by the base flange 5 as extending along the center axis 2*c*.

Referring to FIGS. 1A to 1D, the peripheral member 6 of the core 2 has a peripheral surface 11 which is arcuate about the center axis 2*c*, a pair of end faces 12 respectively extending radially inward from circumferentially opposite edges of the arcuate peripheral surface 11 to a predetermined distance, a pair of opposed surfaces 13 respectively extending from inner edges of the end faces 12 toward the arcuate peripheral surface 11, and a concave surface 14 having an arcuate sectional shape and defining a back surface of the arcuate peripheral surface 11 to connect innermost edges of the opposed surfaces 13 to each other. A space 15 is defined in the core 2 by the concave surface 14 and the pair of opposed surfaces 13.

The pair of support ribs 7 are provided opposite from the arcuate peripheral surface 11 of the peripheral member 6 to be spaced from the peripheral member 6 by the space 15, and extend parallel to the center axis 2*c* symmetrically with respect to the center axis 2*c*. The pair of support ribs 7 are entirely disposed inside the core 2, and also extend away from the center axis 2*c* toward the arcuate peripheral surface 11 in a direction Y perpendicular to both a chord of the semicircular shape of the core 2 and the center axis 2*c*.

Outer side surfaces of the respective support ribs 7 are disposed in adjacent opposed relation to the corresponding opposed surfaces 13, and spaced a predetermined distance from the corresponding opposed surfaces 13 by gaps. As will be described later, the rubber belt 3 is partly fitted in the gaps to be held between the support ribs 7 and the opposed surfaces 13. Further, inner side surfaces of the respective support ribs 7 are parallel to each other, and define an inter-surface width for fixing a rotation shaft to be described later. The support ribs 7 each have an end face 7*c* having a smoothly convexly curved surface and facing inward of the core 2.

The base flange 5 is a semicircular plate member having a greater radius than the arcuate peripheral surface 11 of the peripheral member 6. One-side axial ends of the peripheral member 6 and the support ribs 7 are connected to the base flange 5. Further, the base flange 5 has a semicircular cutaway portion through which the rotation shaft to be described later extends.

Referring to FIGS. 2A and 2B, the rubber belt 3 is a looped belt having a predetermined width as measured along the center axis and having an inner peripheral surface 21 and an outer peripheral surface 22. More specifically, the rubber belt 3 is made of an EPDM rubber, and produced by a process sequence including the following five steps.

1. Rubber kneading step
2. Injection molding step (to form a rubber pipe having a length of about 200 mm)
3. Secondary vulcanization step
4. Cutting step (to cut the resulting rubber pipe to a predetermined product width)
5. Assembling step (to press-insert the core 2 into the rubber belt 3)

In the assembling step, a part of the outer peripheral surface 22 of the circular rubber belt 3 is depressed to bend the rubber belt 3 when the rubber belt 3 is mounted on the core 2.

Then, the peripheral member 6 is inserted into the rubber belt 3, and a portion (predetermined portion 23) of the rubber belt 3 is fitted in the space 15 between the peripheral member 6 and the support ribs 7. Thus, the rubber belt 3 is mounted on the core 2 with the inner peripheral surface 21 thereof partly kept in intimate contact with the arcuate peripheral surface 11 and with the predetermined portion 23 of the outer peripheral surface 22 of the rubber belt 3 supported by the support ribs 7.

Figure 3:
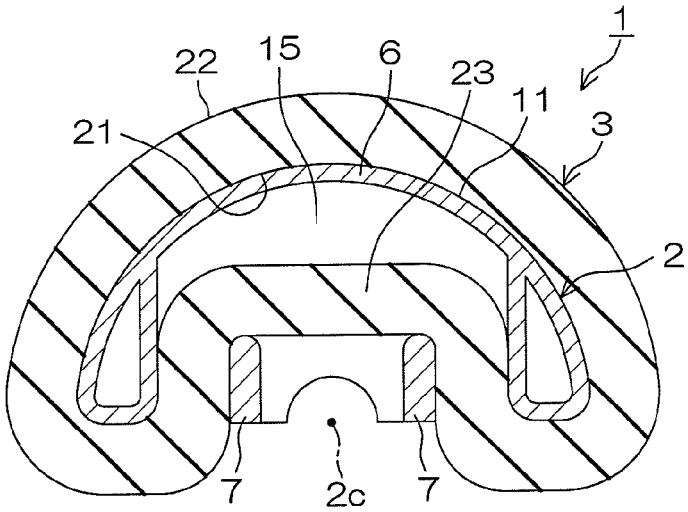
FIG. 3 is a front sectional view of the complete sheet feed roller 1 produced by combining the core 2 and the rubber belt 3 together.

FIG. 3 is a front sectional view of the complete sheet feed roller 1 produced by combining the core 2 and the rubber belt 3 together.

When the rubber belt 3 is mounted on the core 2, as described above, the rubber belt 3 is partly bent by the pair of support ribs 7 and fixed to the core 2 with the inner peripheral surface 21 thereof held in intimate contact with the arcuate peripheral surface 11. This prevents the slack of the rubber belt 3. Further, the provision of the pair of rubber ribs 7 increases the design flexibility for controlling the elongation percentage of the rubber belt 3. As a result, the rubber belt 3 is substantially prevented, for example, from having an excessively high elongation percentage. The increased design flexibility permits easy performance control of the rubber belt 3 in designing and producing the rubber belt 3.

The sheet feed roller 1 according to this embodiment is a sheet feed roller of a non-constant contact type which has a noncircular shape and is brought into contact with a paper sheet only during transportation of the paper sheet. This prevents an ingredient (oil or the like) of the rubber belt 3 of the sheet feed roller 1 from migrating to a paper sheet held in standby for transportation, and makes it possible to select a rubber from a wider range of rubber formulations for the sheet feed roller 1.

Further, the slack and the excessive elongation of the rubber belt 3 can be prevented simply by providing the pair of support ribs 7.

Figure 4:
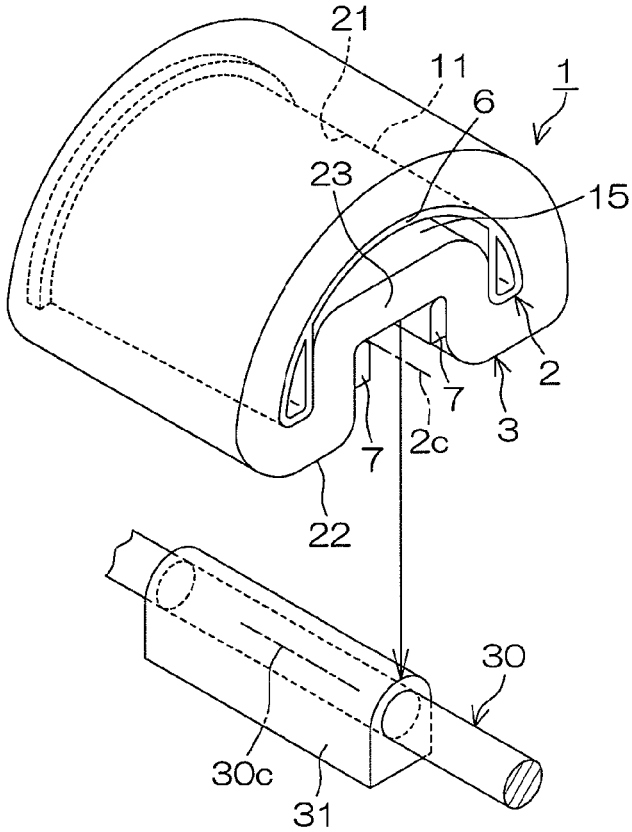
FIG. 4 is a perspective view showing how to attach the sheet feed roller 1 to a rotation shaft 30.
Figure 5:
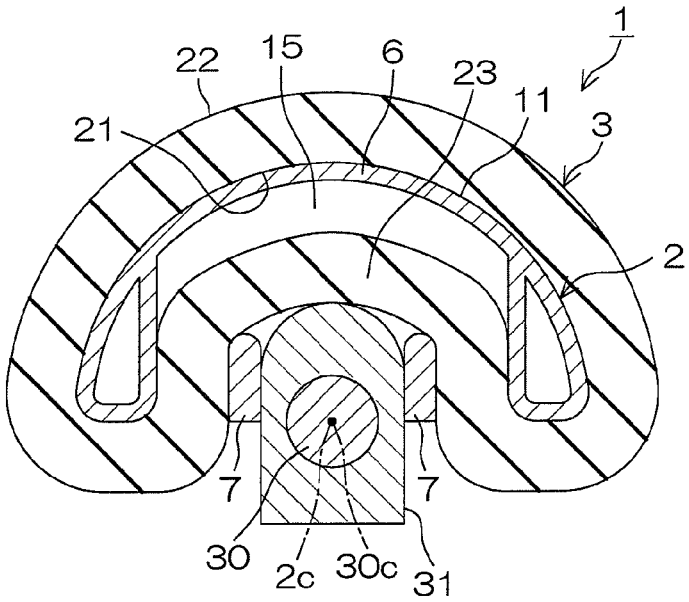
FIG. 5 is a front sectional view of the sheet feed roller 1 attached to the rotation shaft 30.

FIG. 4 is a perspective view showing how to attach the sheet feed roller 1 to the rotation shaft 30. FIG. 5 is a front sectional view of the sheet feed roller 1 attached to the rotation shaft 30.

The sheet feed roller 1 is attached, for example, to a rotation shaft 30 of an image forming apparatus. The center axis 2*c* of the sheet feed roller 1 is aligned with a center axis 30*c* of the rotation shaft 30. That is, the rotation shaft 30 is engaged into the position of the center axis 2*c* within the core 2 from a side of the core 2 opposite from the arcuate peripheral surface 11 through a gap defined between the pair of support ribs 7.

In this embodiment, an inner core 31 is fitted around the rotation shaft 30, and the portion 23 of the rubber belt 3 is depressed to be elongated by the inner core 31.

Figure 6A:
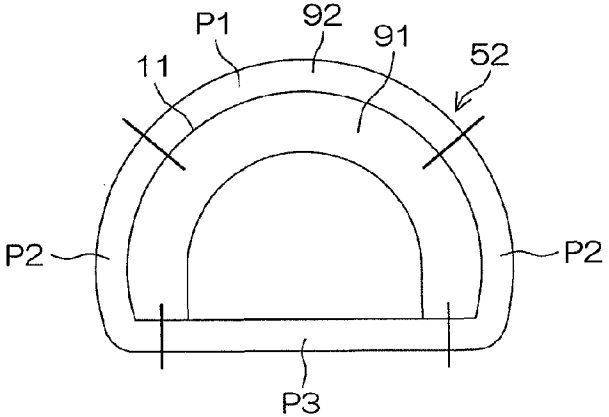
FIGS. 6A to 6D are diagrams for explaining the results of a test performed on a sheet feed roller 51 of an inventive example and a sheet feed roller 52 of a comparative example, particularly, FIG. 6A illustrating the sheet feed roller 52 of the comparative example before it is attached to a rotation shaft 93, FIG. 6B illustrating the sheet feed roller 52 of the comparative example after it is attached to the rotation shaft 93, FIG. 6C illustrating the sheet feed roller 51 of the inventive example before it is attached to the rotation shaft 30, FIG. 6D illustrating the sheet feed roller 51 of the inventive example after it is attached to the rotation shaft 30.
Figure 6B:
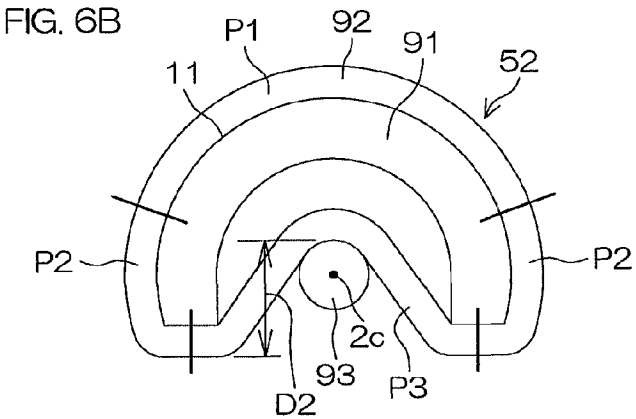
Figure 6C:
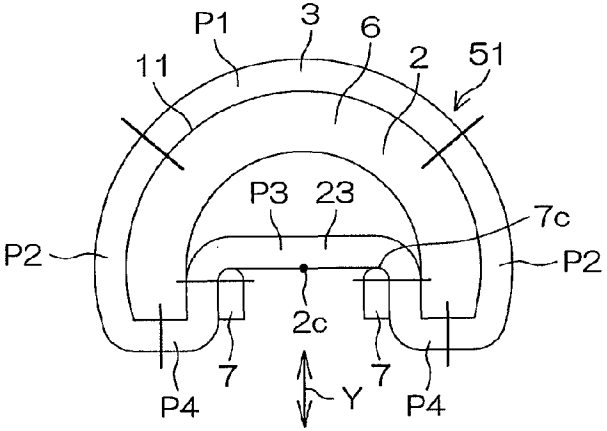
Figure 6D:
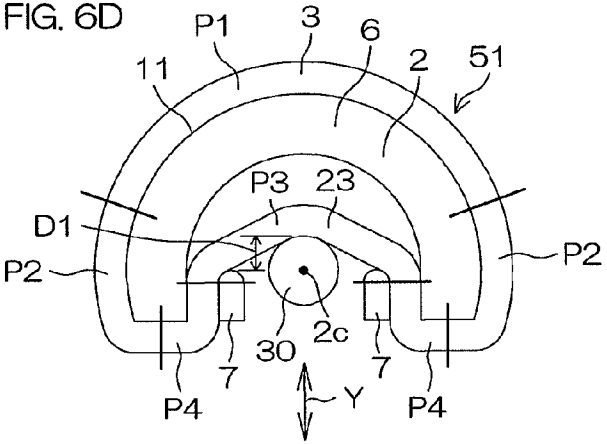

The configuration of the core of the sheet feed roller 1 may be modified so that the rotation shaft 30 directly depresses the rubber belt 3 as shown in FIG. 6D to be described later.

As shown in FIG. 5, the inner core 31 (combined with the rotation shaft 30) depresses the portion 23 of the rubber belt 3 to tighten the rubber belt 3, whereby the inner peripheral surface 21 of the rubber belt 3 is reliably brought into intimate contact with the arcuate peripheral surface 11. Since the pair of support ribs 7 support the rubber belt 3 inside the core 2, the portion 23 of the rubber belt 3 depressed to be elongated by the rotation shaft 30 has a smaller area. As a result, the elongation percentage of the elongated portion 23 of the rubber belt 3 can be reduced to not higher than 25%. This prevents the permanent elongation of the rubber belt 3, and suppresses the cracking of the rubber belt 3 due to ozone.

The elongation percentage is herein calculated from the following expression:

$$\text{Elongation Percentage}(\%)=\text{Length of rubber}/\text{Length of core}2\times100$$

wherein "Length of rubber" means an elongation amount (a difference between a post-elongation length and a pre-elongation length) of a measurement portion of the rubber belt 3 measured in an elongation direction when the rubber belt 3 is elongated on the core 2, and "length of core 2" means the length of a portion of the core 2 corresponding to the measurement portion of the rubber belt 3 measured in the elongation direction and is equivalent to the post-elongation length of the measurement portion of the rubber belt 3.

The sheet feed roller 1 according to this embodiment is applicable to an image forming apparatus such as a printer, a facsimile or a copier.

EXAMPLES

FIGS. 6A to 6D are diagrams for explaining the results of a test performed on a sheet feed roller 51 of an inventive example and a sheet feed roller 52 of a comparative example, particularly, FIG. 6A illustrating the sheet feed roller 52 of the comparative example before it is attached to a rotation shaft 93, FIG. 6B illustrating the sheet feed roller 52 of the comparative example after it is attached to the rotation shaft 93, FIG. 6C illustrating the sheet feed roller 51 of the inventive example before it is attached to the rotation shaft 30, FIG. 6D illustrating the sheet feed roller 51 of the inventive example after it is attached to the rotation shaft 30.

The sheet feed roller 51 of the inventive example shown in FIGS. 6C and 6D and the sheet feed roller 1 shown in FIG. 3 have substantially the same construction, but are different from each other in the following points. Like components will be designated by like reference characters.

In the sheet feed roller 51 shown in FIGS. 6C and 6D, the peripheral member 6 is an arcuate member having a greater thickness. The arcuate peripheral surface 11 extends circumferentially about the center axis 2*c* by a center angle of more than 180 degrees. The end faces 7*c* of the respective support ribs 7 are located at the same level as the center axis 2*c* with respect to the direction Y perpendicular to both the chord of the semicircular shape of the core 2 and the axial direction.

The sheet feed roller 52 of the comparative example shown in FIGS. 6A and 6B is a semicircular sheet feed roller including an arcuate core 91 and a looped rubber belt 92 fitted around the core 91. When the sheet feed roller is fixed to the rotation shaft 93, the rubber belt 92 stretched around the arcuate core 91 is partly depressed inward by the rotation shaft 93 to be thereby tightened. That is, the sheet feed roller 52 is not provided with the pair of support ribs 7. This is the only difference from the sheet feed roller 51 of the inventive example shown in FIGS. 6C and 6D. With this arrangement, the rubber belt 92 is tightened when the sheet feed roller is attached to the rotation shaft 93. The tightened portion of the rubber belt 92 has a higher elongation percentage, and is more liable to suffer from permanent elongation and cracking due to ozone. More specifically, this is verified by the following exemplary experiments.

The deformation amounts of the rubber belts 3 and 92 are expressed by depression amounts D1 and D2, respectively, as measured from the end faces of the cores 2 and 91, and D1<D2.

[Measurement of Elongation Percentage and Results]

The elongation percentages of the following portions of the rubber belts 3, 92 of the sheet feed rollers 51, 52 of the inventive example and the comparative example were measured before and after the sheet feed rollers 51, 52 were attached to the rotation shafts 30, 93.

A portion P1 is a circumferentially middle portion of the arcuate peripheral surface 11. Portions P2 are edge portions of the arcuate peripheral surface 11. The portions P1, P2 cooperatively serve as a transport portion to be brought into contact with a paper sheet when the sheet is transported.

A portion P3 is a portion to be elongated by the rotation shaft 30, 93. In the sheet feed roller 52 of the comparative example, the portion P3 is stretched between end faces of the arcuate peripheral surface 11 adjacent to the edge portions. In the sheet feed roller 51 of the inventive example, the portion P3 is stretched between the pair of support ribs 7. Portions P4 are each stretched between the support rib 7 and the edge portion of the arcuate peripheral surface 11. The portions P3, P4 are not brought into contact with the paper sheet, and cooperatively serve as a fixing portion for fixing the rubber belt 3, 92 to the core 2, 91. Boundaries between the portions P1 to P4 are shown in FIGS. 6A to 6D.

Measurements for the Sheet Feed Roller 52 of the Comparative Example Before Attachment to the Rotation Shaft as Shown in FIG. 6A Elongation percentage of portion P1: 0 to 5%
Elongation percentage of portion P2: 3 to 5%
Elongation percentage of portion P3: 5 to 7%

Measurements for the Sheet Feed Roller 52 of the Comparative Example after Attachment to the Rotation Shaft as Shown in FIG. 6B Elongation percentage of portion P1: 3 to 6%
Elongation percentage of portion P2: 3 to 10%
Elongation percentage of portion P3: 18 to 40%

Measurements for the Sheet Feed Roller 51 of the Inventive Example Before Attachment to the Rotation Shaft as Shown in FIG. 6C Elongation percentage of portion P1: 0 to 5%
Elongation percentage of portion P2: 2 to 4%
Elongation percentage of portion P3: 3 to 5%
Elongation percentage of portion P4: −5 to 2%

Measurements for the Sheet Feed Roller 51 of the Inventive Example after Attachment to the Rotation Shaft as Shown in FIG. 6D Elongation percentage of portion P1: 0 to 5%
Elongation percentage of portion P2: 2 to 6%
Elongation percentage of portion P3: 8 to 10%
Elongation percentage of portion P4: 0 to 3%

[Evaluation of Measurements of Elongation Percentages]

In the comparative example, the maximum value of the elongation percentage of the portion P3 was 40% when the sheet feed roller 52 was attached to the rotation shaft 93. This may result in the permanent elongation of the rubber belt 92 and the cracking of the rubber belt 92 due to ozone.

In the sheet feed roller 51 of the inventive example, on the other hand, the elongation percentages of the portions P1 to P4 of the rubber belt 3 before and after the attachment to the rotation shaft 30 were not higher than 10%. Therefore, there is no possibility that the rubber belt 3 suffers from the permanent elongation and the cracking due to ozone.

In the inventive example, the portion P4 had a minimum elongation percentage of −5% before the sheet feed roller 51 was attached to the rotation shaft 30. This means that the portion P4 included a non-tightened portion. However, this is not problematic, because the portion P4 serves as the fixing portion which is not brought into contact with the paper sheet. Even in this state, the minimum values of the elongation percentages of the portions P1, P2 serving as the transport portion were not less than zero, indicating that the rubber belt 3 was tightened to be kept in intimate contact with the arcuate peripheral surface 11. With the sheet feed roller 51 attached to the rotation shaft 30, the elongation percentage of the portion P4 was not less than zero, indicating that the portion P4 was kept tightened.

[Ozone Test]

Five sheet feed rollers 51 of the inventive examples and five sheet feed rollers 52 of the comparative example were produced, and an ozone test was performed on these sheet feed rollers 51, 52 (at a temperature of 25° C. at an ozone concentration of 50 ppm for 96 hours).

[Results of Ozone Test]

Three of the sheet feed rollers 52 of the comparative example suffered from unacceptable cracking of the rubber belt 92. On the contrary, the sheet feed rollers 51 of the inventive example were free from the unacceptable cracking of the rubber belt 3. In the sheet feed rollers 52 of the comparative example, the portions P3 were cracked.

It should be understood that the inventive embodiment described above is merely illustrative of the technical principles of the present invention but not limitative of the invention. The spirit and scope of the present invention are to be limited only by the appended claims.

This application corresponds to Japanese Patent Application No. 2011-200703 filed in the Japan Patent Office on Sep. 14, 2011, the disclosure of which is incorporated herein by reference in its entirety.

What is claimed is:

1. A noncircular sheet feed roller comprising:

a core; and a rubber belt mounted on the core;

wherein the core includes a peripheral member having a peripheral surface which is arcuate about a center axis thereof, and a pair of support ribs which are provided opposite from the arcuate peripheral surface of the peripheral member to be spaced from the peripheral member by a space and extend parallel to the center axis symmetrically with respect to the center axis;

wherein the rubber belt is a ring shaped belt which has a predetermined width as measured along the center axis and has an inner peripheral surface and an outer peripheral surface;

wherein the peripheral member is inserted in the rubber belt, and a portion of the rubber belt is fitted in the space between the peripheral member and the support ribs, whereby the rubber belt is mounted on the core with the inner peripheral surface thereof partly held in intimate contact with the arcuate peripheral surface and with a predetermined part of the outer peripheral surface thereof supported by the support ribs;

wherein the peripheral member further has a pair of end faces respectively extending radially inward from circumferentially opposite edges of the arcuate peripheral surface to a predetermined distance, a pair of opposed surfaces extending from inner edges of the end faces toward the arcuate peripheral surface, and a concave surface having an arcuate sectional shape and defining a back surface of the arcuate peripheral surface to connect innermost edges of the opposed surfaces to each other, and the space between the peripheral member and the support ribs is defined in the core by the concave surface and the pair of opposed surfaces.

2. The sheet feed roller according to claim 1, which is attachable to a rotation shaft by engaging the rotation shaft into a center axis position through a gap defined between the pair of support ribs, wherein the portion of the rubber belt fitted in the space has an elongation percentage of not higher than 25% with the sheet feed roller attached to the rotation shaft.

3. The sheet feed roller according to claim 2, wherein the portion of the rubber belt fitted in the space has an elongation percentage of not higher than 10%.

4. The sheet feed roller according to claim 1, wherein outer side surfaces of the respective support ribs are disposed in adjacent opposed relation to the corresponding opposed surfaces, and spaced a predetermined distance from the corresponding opposed surfaces by gaps, and the rubber belt is partly fitted in the gaps to be held between the support ribs and the opposed surfaces.

5. An image forming apparatus comprising:

a sheet feed roller including a core and a rubber belt mounted on the core, wherein the core includes a peripheral member having a peripheral surface which is arcuate about a center axis thereof, and a pair of support ribs which are provided opposite from the arcuate peripheral surface of the peripheral member to be spaced from the peripheral member by a space and extend parallel to the center axis symmetrically with respect to the center axis;

wherein the rubber belt is a ring shaped belt which has a predetermined width as measured along the center axis and has an inner peripheral surface and an outer peripheral surface;

wherein the peripheral member is inserted in the rubber belt and a portion of the rubber belt is fitted in the space between the peripheral member and the support ribs, whereby the rubber belt is mounted on the core with the inner peripheral surface thereof partly held in intimate contact with the arcuate peripheral surface and with a predetermined part of the outer peripheral surface thereof supported by the support ribs;

wherein the peripheral member further has a pair of end faces respectively extending radially inward from circumferentially opposite edges of the arcuate peripheral surface to a predetermined distance, a pair of opposed surfaces extending from inner edges of the end faces toward the arcuate peripheral surface, and a concave surface having an arcuate sectional shape and defining a back surface of the arcuate peripheral surface to connect innermost edges of the opposed surfaces to each other, and the space between the peripheral member and the support ribs is defined in the core by the concave surface and the pair of opposed surfaces.

6. The image forming apparatus according to claim 5, wherein the sheet feed roller is attachable to a rotation shaft by engaging the rotation shaft into a center axis position through a gap defined between the pair of support ribs, wherein the portion of the rubber belt fitted in the space has an elongation percentage of not higher than 25% with the sheet feed roller attached to the rotation shaft.

7. The image forming apparatus according to claim 5, wherein the portion of the rubber belt fitted in the space has an elongation percentage of not higher than 10%.

* * * * *